US006523374B1

(12) United States Patent
Owens

(10) Patent No.: US 6,523,374 B1
(45) **Date of Patent: *Feb. 25, 2003**

(54) SAFETY DEVICE FOR FIREARMS

(76) Inventor: William Owens, 40182 LaRoche Rd., Prairieville, LA (US) 70769

( * ) Notice: Subject to any disclaimer, the term of this patent is extended or adjusted under 35 U.S.C. 154(b) by 0 days.

This patent is subject to a terminal disclaimer.

(21) Appl. No.: 09/305,581

(22) Filed: May 5, 1999

Related U.S. Application Data

(60) Division of application No. 08/943,960, filed on Oct. 6, 1997, now Pat. No. 5,916,087, which is a continuation-in-part of application No. 08/684,377, filed on Jul. 19, 1996, now Pat. No. 5,779,114.

(51) Int. Cl.[7] ..... B65D 55/14

(52) U.S. Cl. ..... 70/63; 109/45; 206/317; 42/70.07; 224/243; 340/825.31

(58) Field of Search ..... 70/63; 109/45, 109/47, 48, 53, 54, 58.5; 5/503.1; 340/825.31; 224/244; 206/317; 42/70.01, 1.01, 70.07, 70.06, 70.11, 70.09

(56) References Cited

U.S. PATENT DOCUMENTS

| | | | | | |
|---|---|---|---|---|---|
| 3,530,451 | A | * | 9/1970 | Devine | 340/224 |
| 4,651,544 | A | * | 3/1987 | Hungerford | 70/63 |
| 4,768,021 | A | * | 8/1988 | Ferraro | 70/63 X |
| 5,048,682 | A | * | 9/1991 | Taylor | 206/317 |
| 5,108,019 | A | * | 4/1992 | Woodward et al. | 224/243 |
| 5,111,755 | A | * | 5/1992 | Rouse | 109/47 X |
| 5,118,175 | A | * | 6/1992 | Costello | 206/317 X |
| 5,168,994 | A | * | 12/1992 | Beletsky et al. | 206/317 |
| 5,172,575 | A | * | 12/1992 | Fisher | 70/63 |
| 5,236,086 | A | * | 8/1993 | Mac Taggart | 206/317 |
| 5,329,865 | A | * | 7/1994 | McWard | 70/63 X |
| 5,416,472 | A | * | 5/1995 | Torii, Jr. | 70/63 X |
| 5,449,103 | A | * | 9/1995 | Tilley | 224/244 |
| 5,458,266 | A | * | 10/1995 | Pichot | 224/244 |
| 5,487,234 | A | * | 1/1996 | Dragon | 42/70.07 |
| 5,525,966 | A | * | 6/1996 | Parish | 224/243 X |
| 5,598,151 | A | * | 1/1997 | Torii, Jr. | 340/825.31 |
| 5,779,114 | A | * | 7/1998 | Owens | 224/193 |
| 5,791,172 | A | * | 8/1998 | Deighton et al. | 70/63 |
| 5,826,715 | A | * | 10/1998 | Thompson | 70/63 X |
| 5,901,589 | A | * | 5/1999 | Cordero | 70/63 |
| 5,916,087 | A | * | 6/1999 | Owens | 70/63 X |
| 5,987,941 | A | * | 11/1999 | Zocco | 70/63 |
| 6,065,408 | A | * | 5/2000 | Tillim et al. | 109/45 X |

* cited by examiner

*Primary Examiner*—Suzanne Dino Barrett
(74) *Attorney, Agent, or Firm*—Jones, Walker, Waechter, Poitevent, Carrere & Denegre, L.L.P.

(57) ABSTRACT

A lockable gun safety storage having a rigid mounting member adapted to be fixedly attached to an item, a mounting means positioned on the mounting member, the mounting means adapted to hold a receptacle, said receptacle being sized to receive a firearm therein, said receptacle having a muzzle end and a handle end, said handle end being open, a shield positioned on said mounting member, said shield and said mounting means being moveable with respect to each other, and a locking means to fix the relative position of said mounting means with respect to said mounting member so that when said locking means is locked and a receptacle present in said mounting means, removal of a firearm positioned in said receptacle is prevented.

27 Claims, 10 Drawing Sheets

SAFETY DEVICE FOR FIREARMS

This is a divisional of Ser. No. 08/943,960 filed Oct. 6, 1997, now issued as U.S. Pat. No. 5,916,087, which is a continuation in part of Ser. No. 08/684,377 filed Jul. 19, 1996, now U.S. Pat. No. 5,779,114, both of which are hereby incorporated by reference in their entirety.

BACKGROUND OF THE INVENTION

1. Field of the Invention

The present application relates to firearm safety devices, and in particular, to devices to store and lock firearm with alarm mechanisms to detect access to the stored firearm.

2. Background Art

Firearm usage for sport, hunting and defense has led to a proliferation of registered firearms, extending from handguns to rifles and shotguns. In the hands of the general public, such firearms are often left unattended, loaded, and/or in an easily accessible place. This presents a hazard for children and other unenlightened persons who may have access to the device. There have been many efforts to retain and store firearms and give warning of unauthorized access by way of a variety of containers, safes, rifle racks, and even certain kinds of holsters armed with some security lockout means. However, no simple yet effective device has been found which locks and protects the firearm, and alarms when the weapon is removed without authority. Firearms are increasing in number throughout the U.S. for many reasons, e.g. sporting, collecting, and protection. This increase also has led to an increase of accidental injuries and deaths. Unfortunately, many of these are children who have access to the firearm and mishandle this potentially dangerous device. This creates the need for a firearm security and containment system that acts not only as a safe or lock box, but also acts as an early alert for potentially dangerous situations that may arise.

SUMMARY OF THE INVENTION

The present invention has a repository for holding a firearm such as a handgun, rifle, or shotgun. The repository is lockable but allows easy access to an authorized user. The device includes a switch to detect when a weapon is in the repository and a switch to detect if the device has been opened. The switches may be wired (hard wired or via transmission means) to alarms or recording devices.

OBJECTS OF THE INVENTION

It is an object of the invention to provide a firearm safety receptacle which is easily accessible to an authorized user but unaccessible to unauthorized users.

It is an object of the invention to provide a firearm safety receptacle with a switch for detecting the status of the receptacle.

It is an object of the invention to provide a firearm receptacle which signals when a firearm is removed.

It is an object of the invention to provide a firearm receptacle which records the status of the device, either onboard or remotely.

It is an object of the invention to provide a device for retrofitting a holster with a device for recording the status of the holster.

DETAILED DESCRIPTION OF THE INVENTION

Figure 1B:
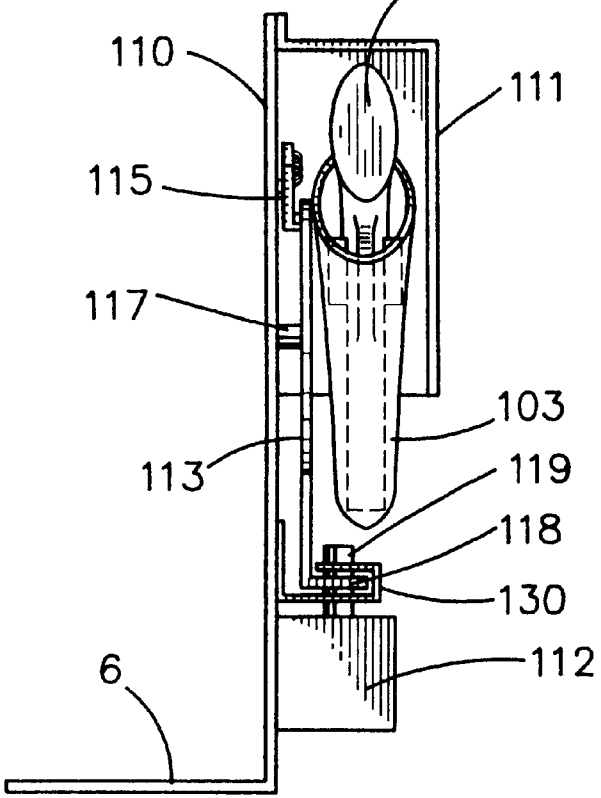
FIG. 1B is a back perspective view of the embodiment shown in FIG. 1A.
Figure 1A:
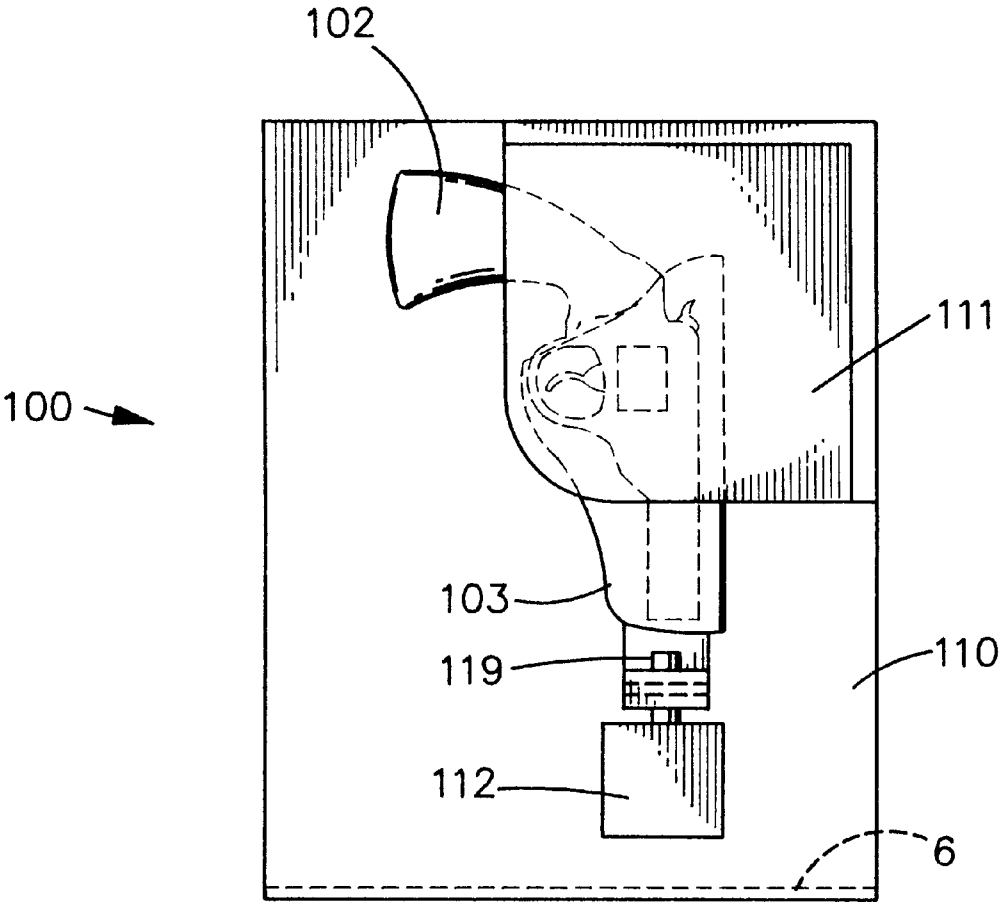
FIG. 1A is a side prospective view of one embodiment of the invention.

The device suitable for a handgun is a mount for a holster, the holster being attached to the mount (either removably or fixedly). As shown in FIG. 1A, the device 100 includes a plate 110, which is a rigid support plate which can be fabricated from many available materials such as wood, plastic, or metal, e.g. stainless, aluminum, or painted steel. This plate 110 can be anchored to a solid surface such as a bed frame, wall, desk, counter or even inside a vehicle as will be discussed later. In addition to the support plate 110, a protective shield 111 is attached to plate 110 and forms an enclosure between plate 110 and shield 111 in which a holster may be placed, as is shown, to protect and secure the firearm from external tampering. The rigid shield 111 is located on one side of the plate 110 and forms a top and one side of an enclosure, blocking top and side removal of a handgun 102 and/or the holster 103 when attached to the plate 110 in the locked position. Shield 111 may also be closed on the back side, as shown, and the bottom (not shown). When the firearm 102 is placed in the device as is shown in FIG. 1A, the firearm 102 may not be removed from the top because the device 100 does not allow proper hand position or adequate space to allow the gun 102 to be withdrawn from the holster 103. Additionally, as will be described, the firearm 102 may not be removed from the open side of the shield 111 unless unlocked.

Figure 2A:
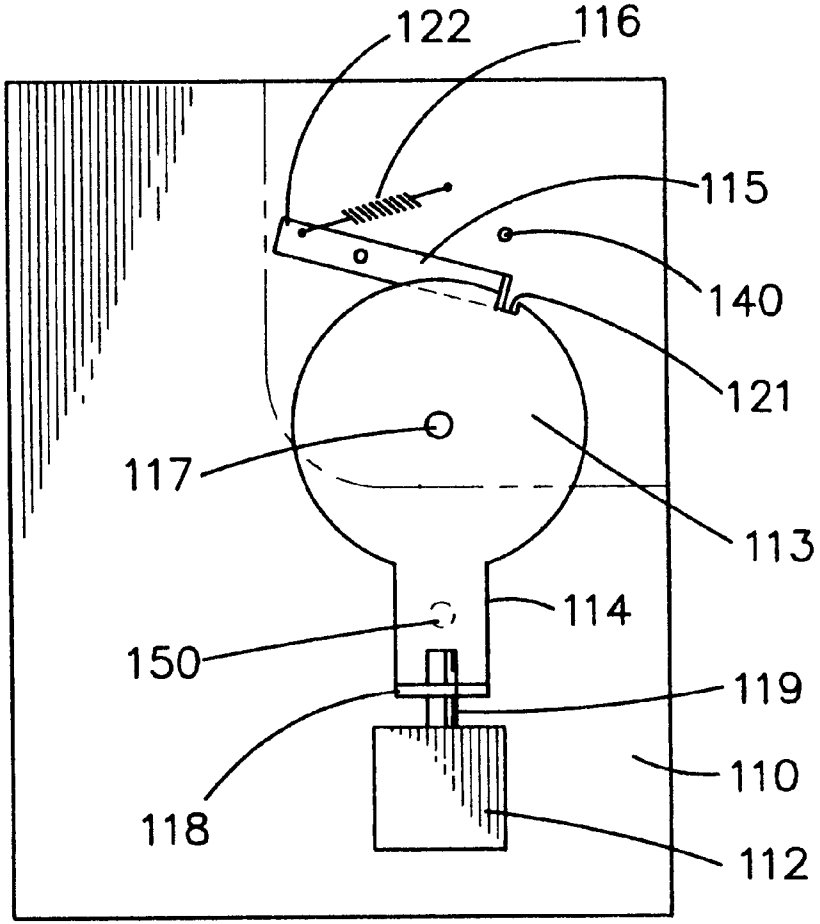
FIG. 2A is a schematic showing details of the bracket, locks and switches.

Shown in FIG. 2A are details of the device 100. Attached to the plate 110 is a bracket 113 for mounting the holster. The shown bracket 113 is pivotally mounted at 117 on the plate 110 through use of a bearing (not shown). The bracket 113 has an elongated section 114 which serves as the locking bracket. As will be described, the holster attaches to the bracket 113. The elongated section 114 terminates in a 90 degree bend to form a locking section 118 (better seen in FIG. 1B). The locking section 118 has a hole therethrough. Mounted below the locking section 118 is a solenoid 112.

Solenoid 112 is designed, when activated, to move plunger 119 through opening in locking section 118. Additionally, "U" shaped bracket 130 with an opening therethrough may be attached to plate 110 so that solenoid plunger 119, when locked, penetrates both bracket 130 and extended bracket. The "U" shaped bracket is added for strength. One configuration of the "U" shaped bracket is shown in FIG. 3A (the solenoid is not shown in this figure for purposes of clarity).

The solenoid 112 can be powered by a battery, an AC, AC/DC power source, or be mechanically operative. When the containment system is used at home, office, or building (places where 120 volt AC is available), an AC to DC transformer is preferred to power the system to avoid the possibility of electrical shock. In order to accommodate this system in a mobile unit such as a vehicle, the power needed to run the system can be adapted to any connection suitable for 12 volt DC connection.

The solenoid 112 can be key activated, or programmable keypad activated, or a remote controlled lock release such as is used in vehicles today, a fingerprint scan, a voice recognition device or other means. The solenoid 112, when activated, pins locking section 118 to plate 111, thereby locking bracket 113 in the vertical position and preventing rotation. Disengagement of the solenoid 112 withdraws plunger 119, and allows bracket 113 to rotate for possible removal of firearm or positioning of a holster attached to bracket 113.

As an added security measure, a second lock is included on the device 100 to prevent unauthorized access. This lock includes a notch 121 in the top of the bracket 113 and a release lever 122. The release lever 122 is pivotally mounted to plate 110 and has a 90 degree bend at its distal end which is designed to engage notch 121 in bracket 113, thus preventing rotation of the bracket 113 when engaged with release lever 122. As shown, release lever 122 is spring loaded by spring 116 to bias the lever 122 into the locked position.

Figure 2B:
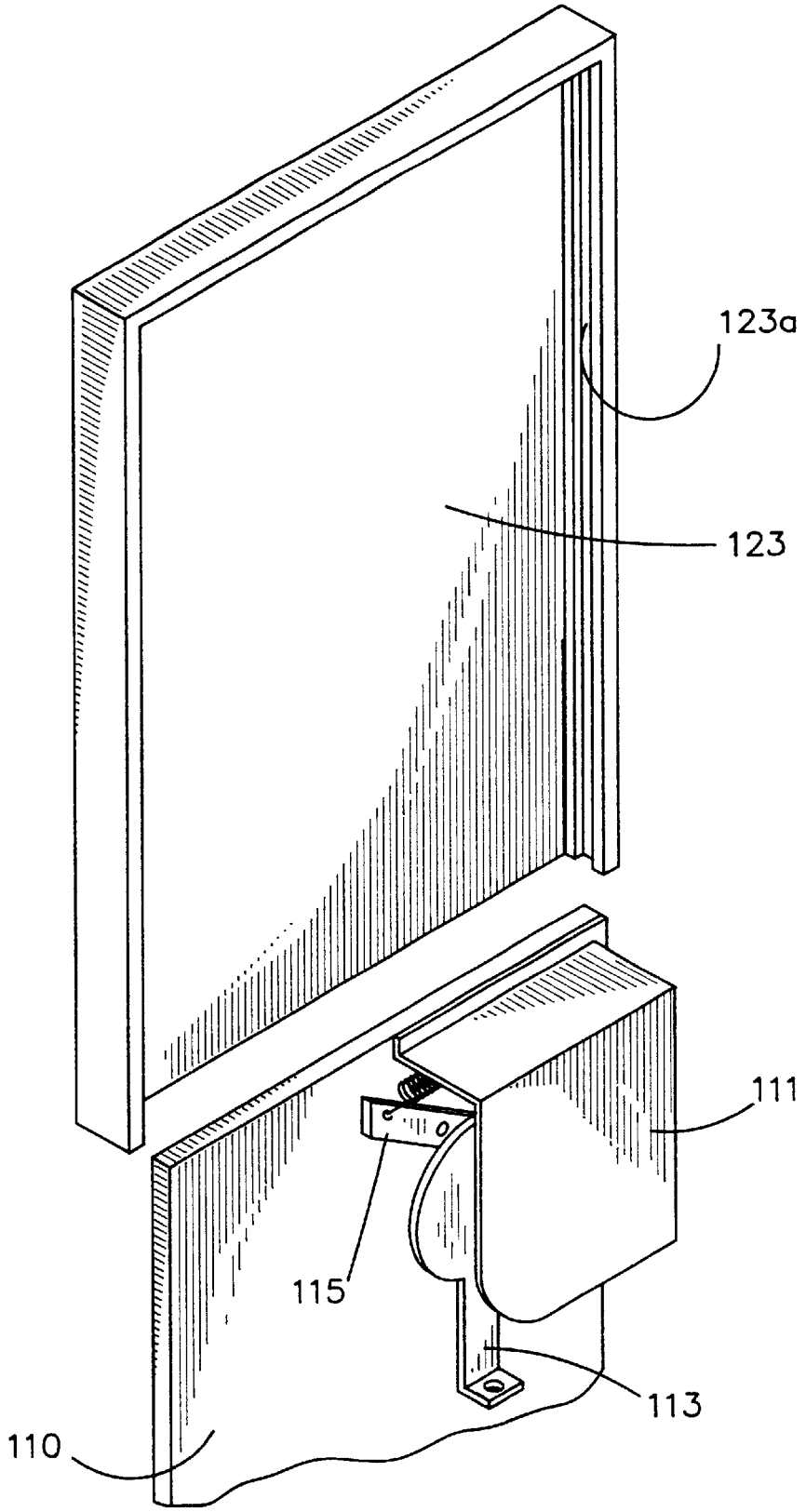
FIG. 2B is a perspective view of one embodiment showing the slotted back plate.

When the solenoid 112 is disengaged and release lever 122 is pressed, bracket 113 is pivoted, allowing rotation of the bracket 113. Thus, when a holster is attached to the bracket 113, the holster may be rotated into a position where the shield 111 does not block access to a firearm in the holster. Details of the wiring runs are not included in the drawings. Generally, the wires will be run on the back side of the device. Shown in FIG. 2B is slotted back plate 123. Slotted back plate 123 attaches to back of plate 110 (as shown, slotted plate 123 slidably engages plate 110 with side slots 123*a*) to protect wires, screw heads, etc. from tampering.

An important feature of the invention is that the bracket 113 be moveable with respect to the shield 111. As shown, bracket 113 pivots with respect to the shield 111. Alternatively, bracket 113 could be linearly slidable with respect to the shield 111 (or alternatively, the shield 111 could be linearly slidable with respect to the bracket 113) or, the shield 111 could be hinged to the plate 110, and hence moveable with respect to the bracket 113. Movement is necessary to enable the holster, when mounted on the bracket 113 to be moved with respect to the shield 111 between two positions, a locked position where the shield 111 blocks access to the top of the holster, and a released position where the shield 111 does not block access to the top of the holster.

Switches may be used on the device 100, such as locking switch 140 and status switch 150, which may work complementary with a security system. The locking switch 140 is designed to sense the release of bracket 113 from the locked position. As shown in FIG. 2, the locking switch 140 senses the release of thumb release lever 115. Alternatively, locking switch 140 could sense the change in status of the solenoid 112. The locking switch 140, as shown, is a contact type switch mounted on the plate 110 in a fashion to be activated when release lever 115 is moved from the locked to the released position. The locking switch 140 may be connected to an audible alarm, a silent alarm, connected to a home security system, or be tied into a recordation system which records the status of the switch.

The status switch 150 detects the presence or absence of a firearm in the holster when the holster is mounted on the bracket 113. As shown, status switch 150 is a contact type switch mounted on the bracket 113. The embodiment shown is designed to operate with holsters having open barrel ends, so that the barrel end of a firearm, when located in the holster, protrudes from the holster and contacts secondary alarm switch 150, thus providing an indication that a firearm is present. The status switch 150 could be a proximity sensor (ferrous/non-ferrous), a magnetic switch or other type of switch. The status switch 150 could be located elsewhere on the device (such as near the handle end of a holster on the bracket 113) dependent on the type of holster deployed. Again, this status switch 150 could be designed to notify a remote location of a change in holster status by automatic dialing system, home-monitoring system, or to a police station.

The locking and status switches can be configured to compliment each other. According to user discretion, one or both switches may be selectively wired to alarms. For instance, an owner of a home security system may choose to select the status switch to activate an audible alarm only at night, but may select both switches to activate an audible alarm during the day when the children may be in the house and in the room where the firearm is unsupervised. In any event, the switches may be monitored by a private security company or police station. In the absence of a home security system the primary alarm switch can be wired to a battery operated audible alarm. The status could then be wired to the phone line using a pre-programmed emergency number, such as a panic button. This would alert the authorities that a threatening condition has occurred. This configuration can be used singularly or together to complement each other.

Figure 3B:
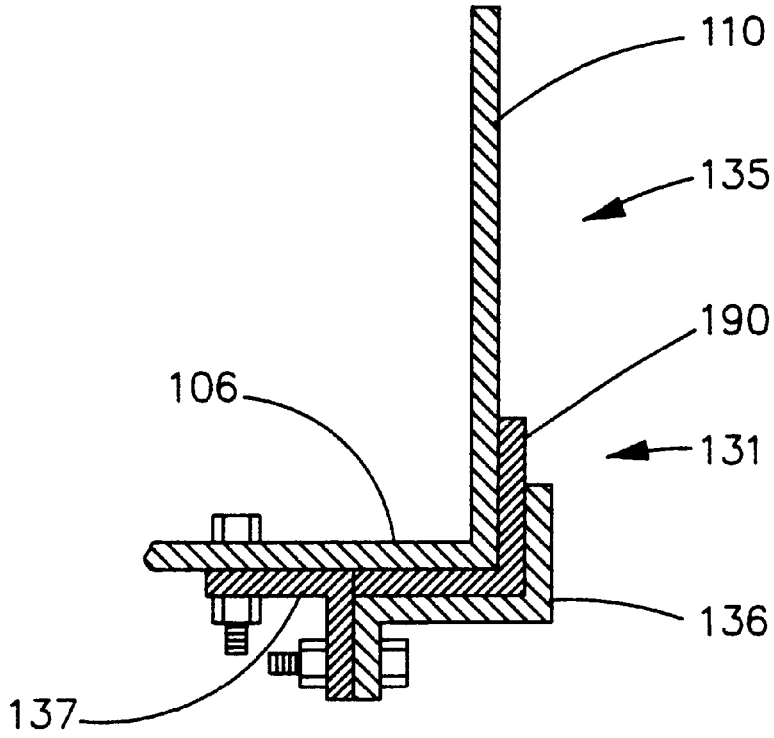
FIG. 3B is a detail of one embodiment of a bed clamp.
Figure 3A:
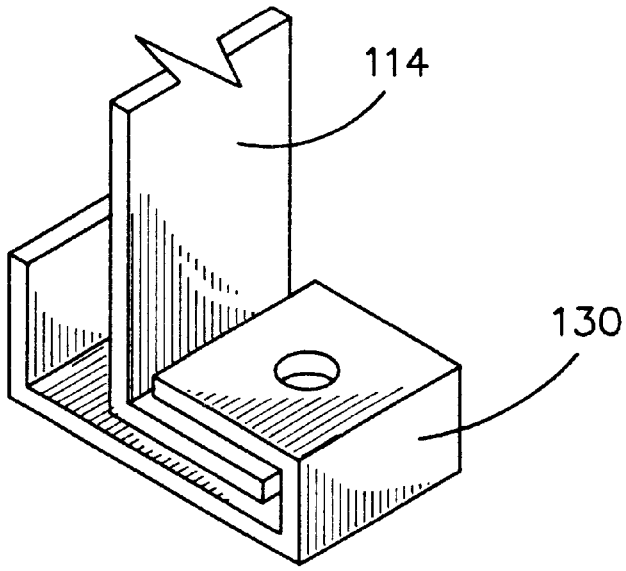
FIG. 3A is a detail of a "u" bracket.

Shown in FIG. 3B is an attachment device 135 for attaching the plate 110 to a bed frame 131, having a "L" shaped box springs support member 190. Attachment device has a first and a second bracket. As shown, plate 110 has a 90 degree bottom bend 106 which rests on bed frame 31, and extends beyond bed frame 31. The first bracket 137 is "L" shaped and bolts to the underside of the plate 110 on the bottom bend 106. The second bracket 136 is "S" shaped and bolts to the first bracket 137, sandwiching the bed frame 131 between the two brackets without the need to drill through the bed frame. For other installations, such as a water bed, car mount, etc., other shapes of the plate 110 and/or brackets may be needed to ease installation.

Figure 3C:
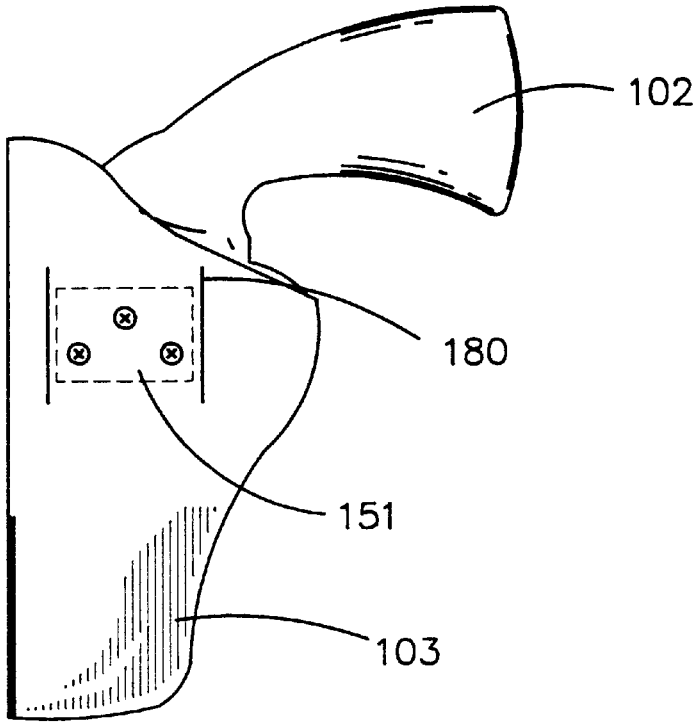
FIG. 3C is a back view detail of a holster belt loop and belt plate.
Figure 3D:
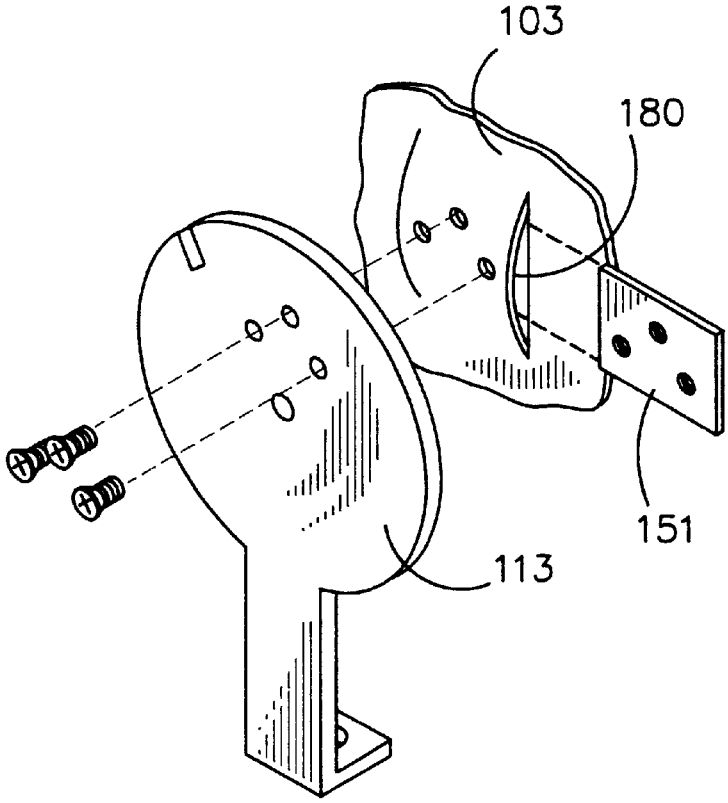
FIG. 3D is a side view detail of a holster belt loop and belt plate.

Finally, shown in FIG. 3C is the body side view of holster 103 showing belt loop 180. Also shown is belt plate 151, a plate which is designed to be inserted into belt loop 180. Belt plate 151 has a series of threaded holes therethrough which align with holes in bracket 113. In this fashion, holster 103 can be attached to device 100 by inserting belt plate 151 into the holster belt loop 180 (like threading a belt), then securing belt plate 151 to locking bracket 113 with screws through bracket 113 into belt plate 151. Alternatively, the holster 103 could be directly attached to bracket 113 by screws into threaded slots in holster 103. Alternatively, a simple receptacle could be attached to bracket 113, into which a holster 103 or firearm could be placed (not shown). As an added safety precaution, it is preferred that the holster be a safety retention holster, such as a triple retention holster as made by various manufacturers (e.g. Michael's of Oregon, P.O. Box 13010, Portland, Oreg.; Bianchi Int'l, 100 Calle Cartez, Temecula, Calif.). FIG. 3D shows a side view of the belt plate 151 in use in holster 103.

Figure 4:
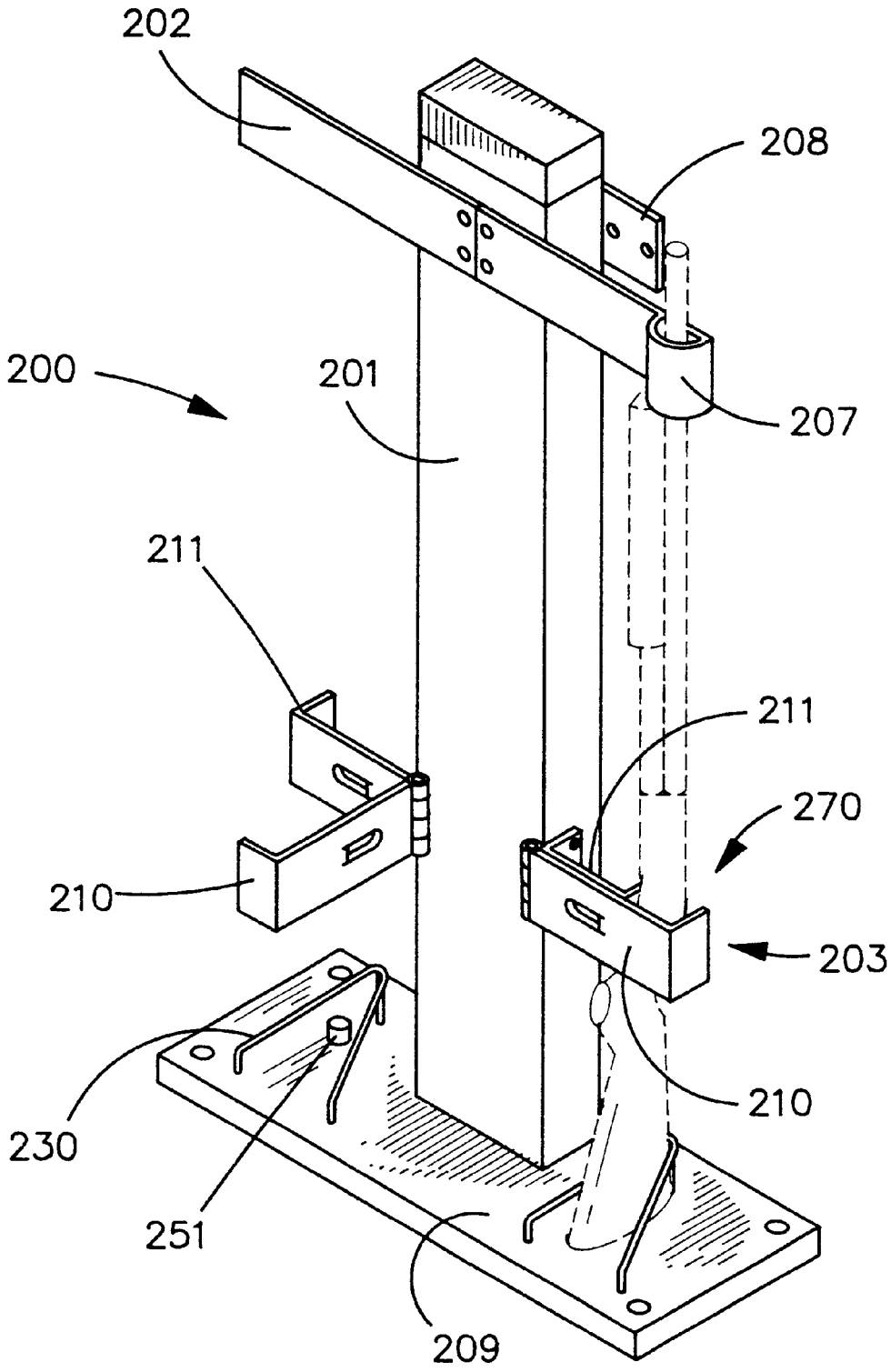
FIG. 4 is a front perspective view of another embodiment of the invention.

Another function of the present invention is the provision of a mechanical release lock which may be used to retain a rifle or shotgun in a receptacle. The design for such a system is used to accommodate both styles allowing weapons with or without scopes. As shown in FIG. 4, the long gun receptacle 200 has a solid base 209 with a central supporting beam 201. The device may have a means to attach to another item, such as bracket 208 for attaching beam 201 to a wall or other fixed structure. Again, materials for fabrication can be wood, plastic, or metal (stainless steel, aluminum, painted metal). The firearms in reference are stationed on either side of the beam 201. Two cross braces, top brace 202 and bottom brace 203, extend perpendicular to the vertical support beam 201. On each brace, suitable retaining mechanisms are used to secure the firearm in position. The top brace 202 supports an electronic hinged barrel lock 207, available from Santa Cruz Associates, 2301 Tucker Rd., Hood River, Oreg. The barrel lock 207 is key activated, and may be opened with or without power to the lock.

Figure 5:
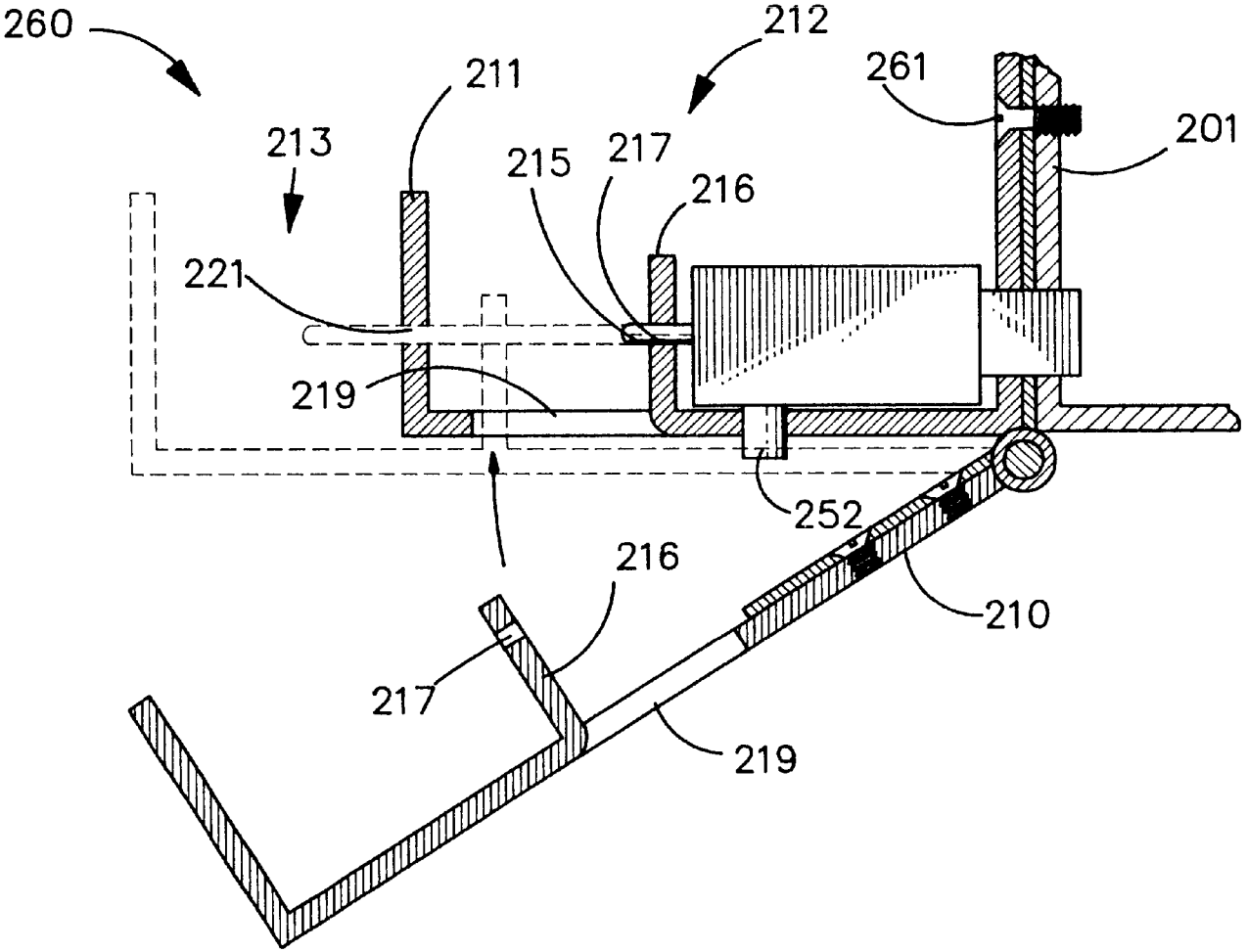
FIG. 5 is a detail of the locking arm of FIG. 4.

Bottom brace 203 consists of two arms, a first hinged arm 210 and a second fixed arm 211. Hinged arm is long "L" shaped arm, while fixed arm is a shorter "U" shaped arm. The hinged arm 210 opens toward the front of the device 200, and when closed, the hinged arm 210 overlaps the fixed arm 211, as shown in FIG. 5, forming a first "U" shaped area 212 and a second "U" shaped area 213. Each arm has an opening 219 therethrough, the opening formed by cutting a tab 216 in the material of the arm, and bending the tab rearwardly. The openings in the two arms are positioned to align within the first "U" shaped area, as shown in FIG. 5. Each tab 216 has a hole 217 therethrough, each hole aligned with another hole 221 on one leg of the "U" shaped fixed arm 211. The bottom brace 203 is positionable along beam 201, (such as by arms to beam 201 with bolts 261, shown in FIG. 5) and a desired position for bottom brace 203 along beam 201 is so that "U" shaped area 213 encloses the trigger area of a weapon stored therein, thus creating a lockable trigger guard 270.

Located in first "U" shaped opening 212 is a solenoid activated plunger 215. The plunger 215, when the solenoid is activated, extends through holes 217 in the tabs 216 and also the hole 221 on one leg of the fixed arm. Thus, when the solenoid is activated, the two arms 210 and 211 are locked together by action of the plunger 215.

As shown in FIG. 4, on the base 209 of device is a triangular stop 230. Stop 230 is open on the front side, and as shown, has three legs which slide matingly into holes in base 209. The butt of the rifle is placed on base and partially supported by stop 230. Stop 230 may have a cover to protect the stock of a rifle placed therein. The stop 230 prevents rearward movement of the firearm in the device. However, in the event of power failure, the weapon can be removed from the device by: (1) manually opening the electronic lock 207 (key override); (2) removing stop 230 from the base 209 (by pulling upwardly on stop 230); and (3) moving stock end of weapon rearward and muzzle end of weapon forward. In this fashion, it is not necessary to open the hinged arm 210, which generally will not operate without power.

The device 200 includes two switches; a status switch 251 and a locking switch 252. As shown on FIG. 4, status switch 251 is a contact switch located on base 209 within triangular area of stop 230. When a rifle is placed in the device 200, the butt of rifle will engage status switch 251, thus providing an indication that a rifle is in the device. Locking switch 252 is a switch to indicate that the device is locked, and may be located to indicate the status of the trigger guard lock 270 or the status of the barrel lock 207. As shown in FIG. 5, locking switch 252 is another contact type switch positioned on the fixed arm 211, and designed to be closed when hinged arm 210 contacts fixed arm 211. Other embodiments for a locking switch 252 could be used, such as a contact switch operated by action of plunger 214 when the solenoid is activated, or a switch indicating that the barrel lock is closed or open. As above, proximity switches, magnetic type switches, or other types of switches can be used.

This hinged trigger guard 270 traps the firearm and protects against trigger tampering. In operation, the solenoid lock and the barrel lock can be wired in series so that both open in response to the same signal, either by operation of a key, numerical entry from a keypad, etc. When both locks are open, the gun can be easily removed.

Figure 6A:
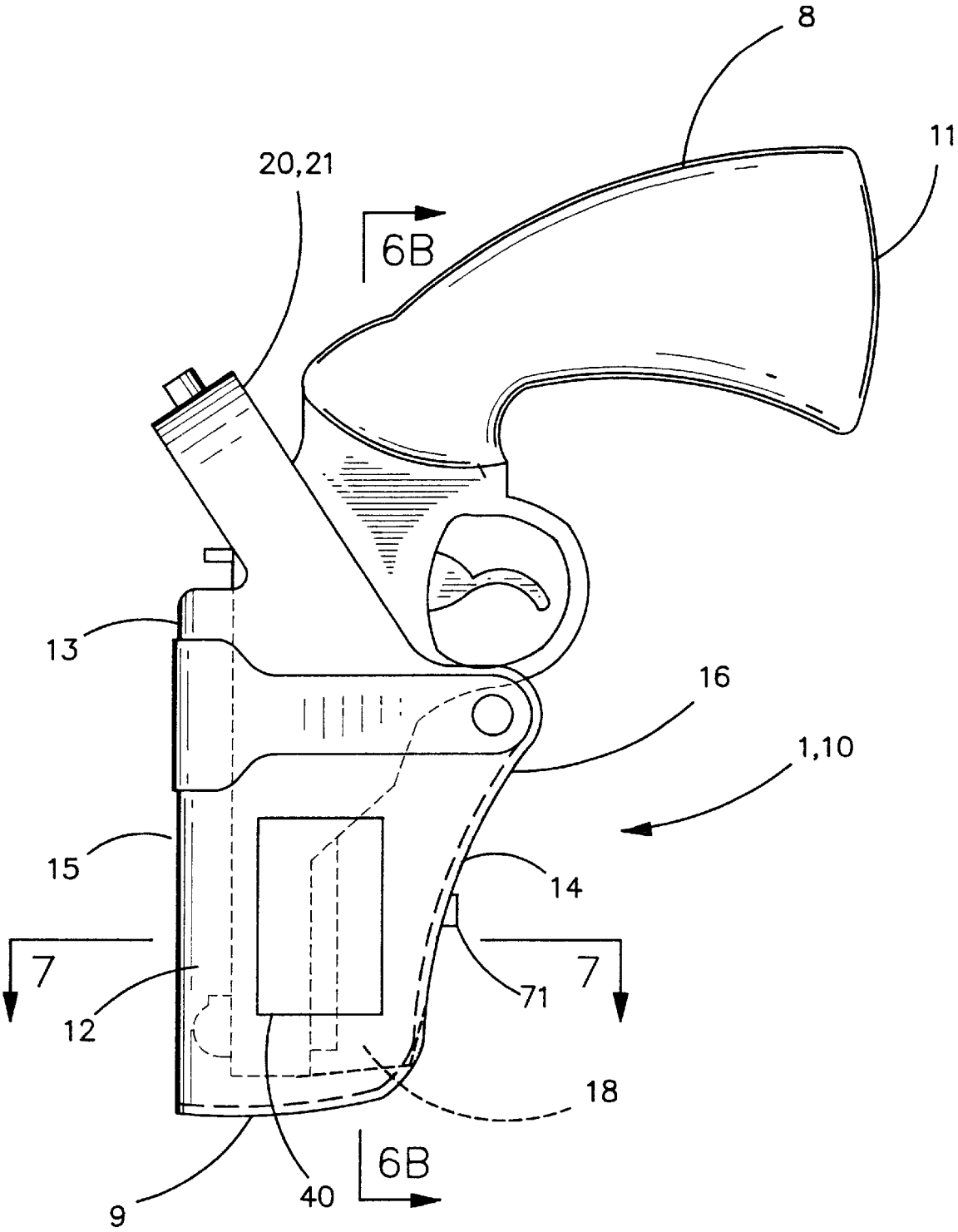
FIG. 6A is a perspective side view of a holster embodiment of the invention.
Figure 6B:
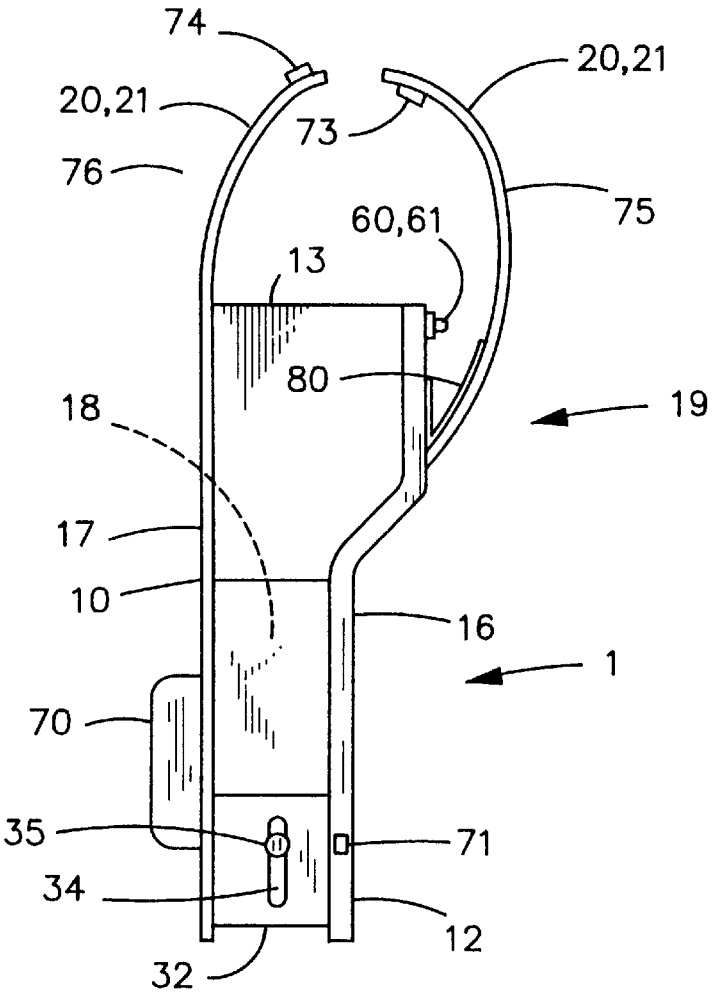
FIG. 6B is a back view of the embodiment of FIG. 6A.

Another embodiment of the invention is a device for monitoring the status of a holster. FIGS. 6A and 6B shows a receptacle 1, in this instance a holster 10, sized to receive a firearm, shown as a handgun 11. Receptacle, as used in this document, is meant to encompass any apparatus adapted to store a firearm, such as the slots in a gun cabinet, or a rifle rack for use in a truck, or a rifle carriage for use in local police armories etc. Firearm has a muzzle 9 and a butt 8. Shown in FIGS. 6A and 6B is releasable retention device 20 for retaining a firearm in an engaged position in the receptacle 1. As shown in FIG. 6B, retention device 20 is a clipable strap 21. Holster 10 has a muzzle end 12, a butt end 13, a back 14, a front 15, a body side 16 and a hand side 17. Back 14, front 15 and sides 16 and 17 define an interior 18 and an exterior 19. Interior 18 is adapted to receive a handgun 11.

Figure 7:
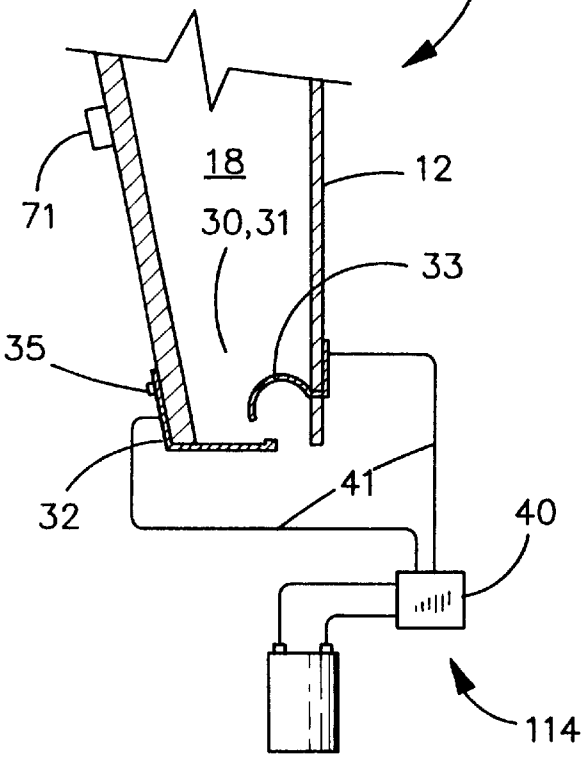
FIG. 7 is a cross section through line 2—2 of FIG. 6A.

Shown in FIG. 7 located at muzzle end 12 is a first signal means 30 for generating a first status signal reflecting the status of the receptacle 1 as to whether a firearm is engaged or disengaged in the receptacle 1. As shown, first signal means 30 is a first switch 31. First switch 31 has a first contact 32 and a second contact 33, positioned near muzzle end 12 of holster 10. The first status signal is generated by an indication of open or closed contacts on first switch 31.

First contact 32 and second contact 33 are metal strips, designed to form an electrical contact switch. As shown, second contact 33 is a deformable piece of spring steel, having a "U" shape. First contact 32 may also be formed of deformable spring steel. First contact 32 and second contact 33 are electrically connectable to box 40 through wiring 41 or other means. Box 40 may be a variety of devices which will be described later. Box 40 may be located on receptacle 1 or be remote from receptacle 1.

When a handgun 11 is placed in the interior 18 of holster 10, the muzzle 9 of handgun 11 will come in contact with second contact 33. As handgun 11 is fully engaged in interior 18 of holster 10 (engaged is used in the sense that the handgun is in its resting position in receptacle), the spring steel of second contact 33 is forced downward into contact with first contact 32. To accommodate different sized handguns, particularly different muzzle lengths, the position of first contact 32 or second contact 33 (or both) may be adjustable with respect to holster 10. As shown first contact 32 is slidably adjustable by means of slot 34 through first contact 32 with adjustment set by set screw 35 positioned through slot 34 and engaging a threaded opening in receptacle 1.

First switch 30 may be located in positions on the receptacle 1 other than near the butt end 13. However, when receptacle 1 is a holster, the butt end 13 location is preferred because a switch positioned on the butt end 13 will generally provide an earlier indication that a firearm is being removed from the holster 10. Other switch embodiments besides a contact type switch may be used, such as a pressure switch, a single micro-switch, a proximity switch, a magnetic switch, an electromagnetic "eyebeam" switch, etc. Alternatively, first contact 32 and second contact 33 may be designed not to directly contact one another, but to come into electrical contact through the metal of a firearm when such is positioned in the interior 18 of the holster 10. As described, the first switch 30 provides a first status signal reflecting the status of the receptacle 1. In the configuration shown, electrical continuity through first switch 30 reflects that a firearm has engaged the receptacle 1, with an electrically open condition reflecting that the firearm has disengaged from the receptacle 1. Obviously, this configuration could be reversed, with continuity reflecting weapon disengaged and an open condition reflecting engagement.

First signal means 30 is electrically connectable to box 40. Box 40 may be an alarm located on receptacle 1, or a remote alarm, such as contained in a home security system or an automobile security system. Alternatively, box 40 may be a transmission device, such as a radio transmitter located on receptacle 1, to transmit the status of the receptacle 1 to a remote device, and the corresponding reception device, such as remote alarm, or a remote recording device, to record the status of the receptacle 1. If box 40 is a transmission/reception device, it is preferred that the transmission be to a reception device located in the immediate vicinity of the holster, such as on the belt of an officer, or elsewhere on the officer, or, for a holster located in a squad car, the reception device could be located somewhere in the squad car. The function remains the same—simply to record holster status and later download of status information.

Box 40 may also be a recording device positioned on receptacle 1 (or a transmission/receptor combination with the receptor located in the vicinity of the holster) such as a microprocessor equipped with memory, to record the status of the receptacle 1. "Recording the status" (or "transmitting the status") includes recording (or transmitting) only a change in the status of receptacle 1, such as a change from firearm engaged to disengaged, or only recording (or transmitting) a desired change in status. For instance, there may be no interest in recording the status change from disengaged to engaged. Alternatively, "recording of status" (or "transmitting of status") can mean continuous recording (or transmission) of status, recording (or transmission) of a desired change in status and of time elapsed until the receptacle 1 status reverts to the previous state.

Figure 8:
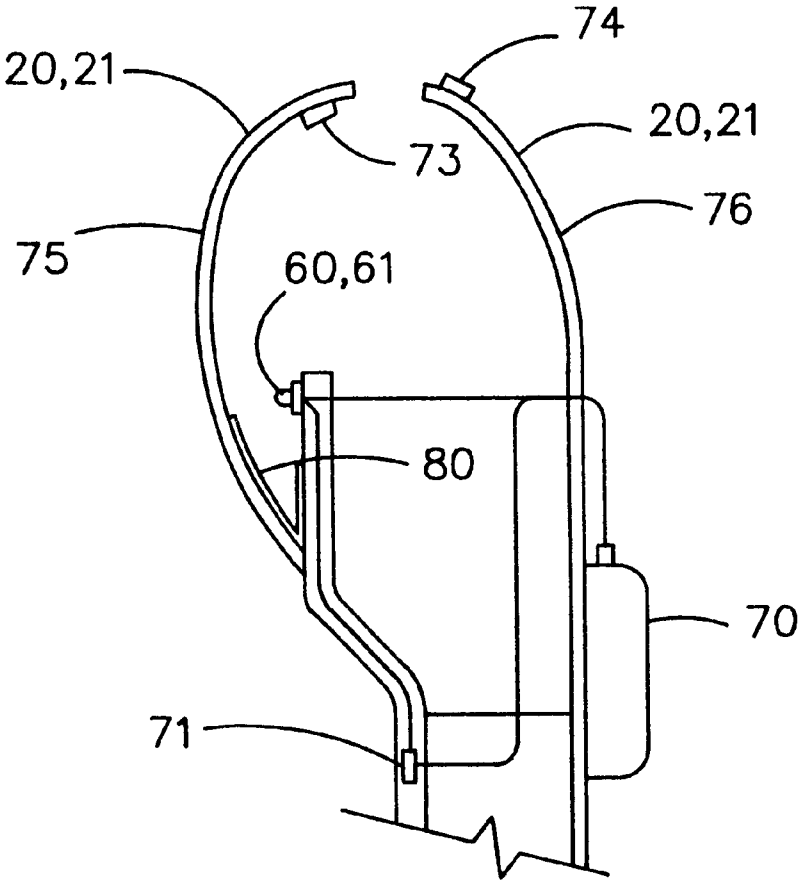
FIG. 8 is a cross section through line 3—3 of FIG. 6A.

Shown in FIG. 8 is second signal means 60 for generating a second status signal reflecting the status of the retention device 20. Retention device 20 is a strap 21 located near butt end 13 of holster 10, and has two pieces, a body piece 75 and a hand piece 76, the pieces equipped with mating fasteners, such as interlocking metal snaps 73 and 74. The two pieces 75, 76 of the retention device 20 are designed to wrap over the butt 8 of a firearm positioned in the interior 18 of the holster 10, thereby retaining or "locking" the weapon in the interior 18 of the holster 10. Obviously, a single piece strap 21 engagable with the opposing side wall of holster 10 could also act as a retention device. For a gun rack, retention device may be a sliding or pivoting bar engagable with gun rack designed to lock rifle or shot gun in position in the rack, or a trigger-guard type lock.

Second signal means 60, as shown, is a pressure actuated micro-switch 61 positioned on the body side 16 of butt end 13 of holster 10. Also shown is biasing spring 80 attached to body side 16 of butt end 13 of holster 10, and positioned between body piece 75 of strap 21 and holster 10. Biasing spring 80 biases the strap piece 75 away from holster 10 when retention device 20 is opened or released, preventing strap piece 75 from providing a false second status signal by contacting micro-switch 61.

Micro-switch 61 is electrically connected to second alarm 70 positioned on hand side of holster 10. Second alarm 70 includes integral battery, but battery may be separate. Second alarm 70/micro-switch 61 combination is configured to sound alarm if micro-switch 61 is open. In this fashion, the alarm circuit of micro-switch 60 and second alarm 70 could not be "disarmed" by cutting the electrical connection between micro-switch 60 and second alarm 70; in fact, cutting the electrical connection would result in an open circuit setting off second alarm 70. However, it may be advantageous to have a disarming switch 71 to disarm second alarm 70. Preferably, disarming switch 71 will be a keyed switch to only allow the one having the key to disarm the circuit.

Other embodiments of switches could also be used. For instance, the metal snaps 73 and 74 could be electrically or magnetically connectable, for instance by wires embedded in the straps, thus forming a contact-type switch or a magnetic type-switch.

Second signal means 60 and first signal means 30 could be wired to same alarm, and be disarmed by same disarming switch. However, the preferred embodiment, incorporating both signal means, would have each signal means electrically tied to its own alarm with separate disarming switches. This apparent "redundancy" provides additional flexibility. For instance, if the first signal means 30 is electrically connected to a silent home alarm, and the second signal means 60 is electrically connected to a non-silent alarm, the owner, in a burglary type situation, will want to disable the second signal means 60 in order to draw the weapon without sounding the audible alarm, but still desire to have the silent alarm notify the police that a weapon has been drawn. If the owner is not present, the owner may wish both alarms to be enabled: the first alarm sounding in an attempt to scare off a burglar or child from drawing the weapon, and if the weapon is drawn, to notify the police or other emergency responsive agency through the second silent alarm which is responsive to the second signal means that a weapon has been drawn.

Figure 9A:
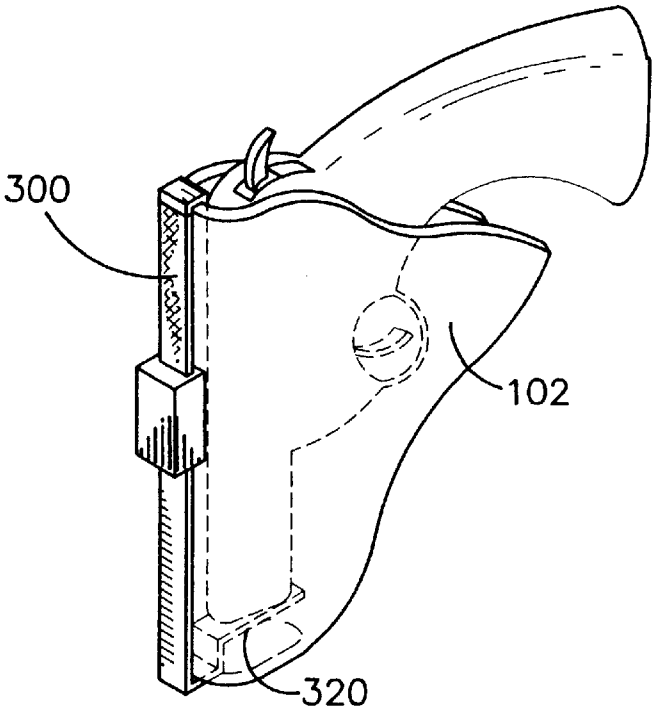
FIG. 9A is a side perspective view of one embodiment of the invention attached to a holster.
Figure 9B:
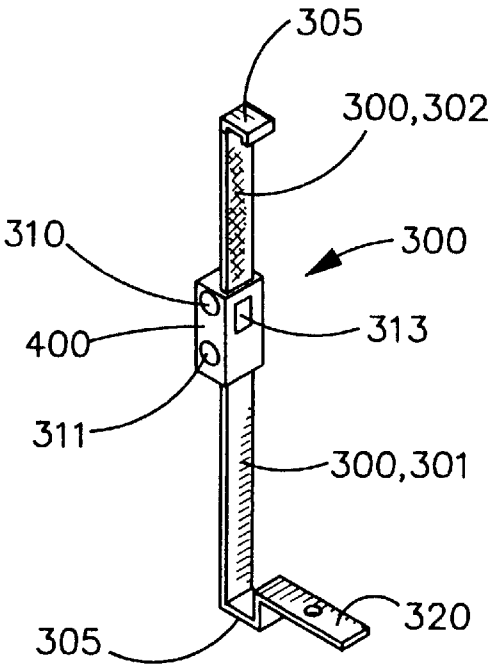
FIG. 9B is a front perspective view of the embodiment shown in FIG. 9A.

For existing holsters, the device can be incorporated as a retrofit with the embodiment shown in FIG. 9. Shown in FIG. 9A is the device attached to a holster 102. As detailed in FIG. 9B, the device is strap 300, strap having a muzzle end 301 and a stock end 302. Muzzle end 301 and stock end 302 have clips 305 for attaching to a holster 102. Clips 305 may be as simple as a hook engagable with an edge of the holster 102. To fit a variety of holster sizes, strap 300, it is preferred that one portion of strap be stretchable, such as stock end 302 of strap.

Connected near the muzzle end 301 of strap 300 is status switch 320. Status switch 320 is designed to detect the status of the holster, that is, whether a weapon is present or absent in the holster. As shown, status switch 320 is a contact or limit switch designed to extend into the open end of the muzzle end of holster and contact the muzzle of a handgun when placed in the holster. If holster 102 has no open muzzle end and the user does not wish to so alter the holster, status switch 320 could be a proximity switch, magnetic switch or other switch capable of detecting the metal of a firearm through the holster fabric.

The sections 302 and 301 of the strap 300 are joined at junction member 400. As shown junction member 400 is a semi-rigid box which can include a variety of devices, such as power means (such as a battery) a microprocessor for recording the status of the switches, a transmitting device to transmit the status of the switches to a remote recording device, or alarms for alarming based on the position of the various switches. Junction member 400 may include an arming means 310, shown as a multi-position key means, to arm the functions of the strap or arm certain functions of the strap (such as arming recording of status but not audible alarms) and a downloading terminal 311, to access information stored in memory of microprocessor. Depending on the functions desired, suitable devices can be mounted injunction member 400, such as alarms, microprocessor, recording devices and/or transmitting devices for status of the switches.

Figure 9C:
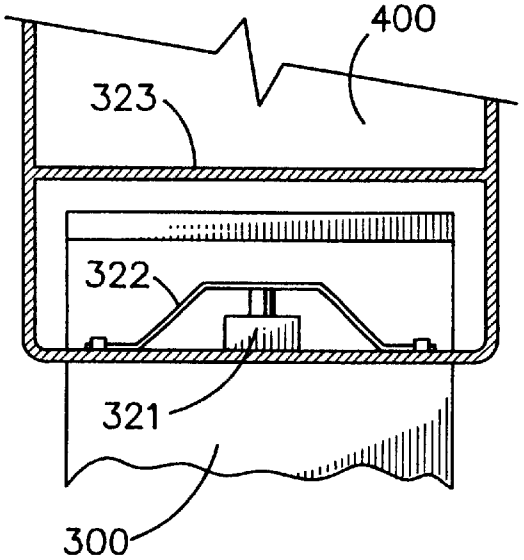
FIG. 9C is a detail of the junction member of the embodiment shown in FIG. 9A.

Strap 300 can include additional switches. For instance, shown is locking switch 313, a contact type switch placed on the side of the junction member 400 which faces the holster. Upon attaching the strap 300 to the holster 102, switch 313 changes state, thus serving as an indicator that the strap 300 is in place. Another type of locking switch to detect whether the strap is attached is shown in FIG. 9C. Shown is a partial cutaway view of junction member 400, showing the elastic section of strap 300 entering junction member 400. Positioned injunction member 400 is contact switch 321 and retention spring 322. Attached to end of elastic section of strap 300 within junction member 400 is a rigid bar 323. When the strap 300 is in place, elastic section stretches, drawing bar 323 down onto retention spring 322, compressing retention spring 322 until spring contacts switch 321, thus indicating the strap 300 is in place. Upon removal of the strap 300, retention spring 322 uncompresses and is no longer in contact with switch 321.

Both switches 321 and 313 could be utilized in conjunction. For instance switch 313 could be used to trigger an audible signal in the event tampering or removal is occurring. Switch 313 could be tied to a recording means to record when the strap was removed. Under normal conditions this retrofit system simply records firearm handling on any given work period or shift. At the end of the shift, the unit is keyed off and memory is downloaded onto a predetermined program.

In all of the above embodiments, the device can have either or both of the status switch and locking switch. The switches can be tied to various devices, such as alarms, recording devices, or transmitting devices. The alarms, recording devices and transmitting devices can be controlled by a microprocessor located on the device. If the device includes a recording means (either remote or onboard), the device can include a means to download recorded information. The device may include an arming means, to enable the function or functions of the device. The device may also include a sensor light to indicate whether the system is activated or deactivated.

I claim:

1. A safety device for a firearm comprising a receptacle adapted to receive a firearm, said receptacle having a status as to whether a firearm is engaged or disengaged in said receptacle, said receptacle having a first signal means for generating a first status signal reflecting said status of said receptacle, said safety device further having a trading device, said tracking device responsive to said first status signal and adapted to record the status of said receptacle when said tracking device is in the vicinity of said receptacle.

2. A safety device for a firearm receptacle having a status as to whether a firearm is engaged or disengaged in said receptacle, said safety device comprising a first signal means engagable with said receptacle, said first signal means for generating a first status signal reflecting said status of said receptacle, said safety device further having a tracking device, said tracking device responsive to said first status signal and adapted to record the status of said receptacle when said tracking device is in the vicinity of said receptacle.

3. A device according to claim 2 further having a second signal means for generating a second status signal reflecting said status of said device as engaged or disengaged on said receptacle.

4. A device according to claim 3 wherein said tracking device is also responsive to said second status signal.

5. A device according to claim 2 further having an alarm, said alarm responsive to said first status signal.

6. A device according to claim 2 further having a strap attachable to said receptacle, said first signal means mounted on said strap.

7. A device according to claim 6 wherein said tracking device includes a microprocessor having a timing means and a memory means for recording said status.

8. A device according to claim 2 further having a download means to access said recorded status.

9. A device according to claim 7 further having a transmission means to transmit said first signal to said microprocessor.

10. A lockable gun safety storage device comprising a mounting member and a receptacle, a mount attached to said mounting member, said mount adapted to mount said receptacle on said mounting member, said receptacle being sized to receive a firearm therein, said receptacle having a muzzle end and a handle end, a shield positioned on said mounting member, said shield and said mount being moveable with respect to each other, a lock to fix the relative position of said mount with respect to said shield so that when said lock is locked and a receptacle present in said mount, removal of a firearm positioned in said receptacle is prevented, said receptacle having a status as to whether a firearm is engaged or disengaged in said receptacle, said device further having a first signal means for generating a first status signal reflecting the status of the receptacle as to whether a firearm is engaged or disengaged in said receptacle.

11. A device according to claim 10 further having a second signal means for generating a second status signal reflecting the status of the locking means as locked or unlocked.

12. A device as in claims 10 wherein said receptacle is a holster.

13. A device as in claim 12 wherein said shield is movable with respect to said mount.

14. A device as m claim 12 wherein said shield is movable with respect to said mounting member.

15. A device as in claim 12 wherein said mount is a bracket.

16. A device as in claim 11 wherein said receptacle is a holster.

17. A device as in claim 16 wherein said shield is movable with respect to said mount.

18. A device as in claim 16 wherein said shield is movable with respect to said mounting member.

19. A device as in claim 14 wherein said mount is a bracket.

20. A lockable firearm safety device comprising a receptacle adapted to hold a firearm, a first signal means for generating a first status signal reflecting the status of the receptacle as to whether a firearm is engaged or disengaged in said receptacle, a first and a second lock to prevent removal of a firearm positioned in said receptacle when either of said locks are locked.

21. A device as in claim 20 further having a trigger guard protector positioned on said receptacle.

22. A device as in claim 20 further having a second signal means generating a second signal reflecting the status of said first lock as locked or unlocked.

23. A device as in claim 21 wherein said second lock is said trigger guard, said device further having a third signal means generating a third signal reflecting the status of the trigger guard as locked or unlocked.

24. A device according to claim 20 further having an alarm, said alarm responsive to said first signal.

25. A device according to claim 24 further having an alarm, said alarm responsive to said first or said third signals.

26. A device as in claim 20 wherein said receptacle is a holster.

27. A device as in claim 20 wherein said receptacle is a rifle holder.

* * * * *